US008303004B2

(12) United States Patent
Lee et al.

(10) Patent No.: US 8,303,004 B2
(45) Date of Patent: Nov. 6, 2012

(54) DOOR LATCH APPARATUS FOR VEHICLES

(75) Inventors: Sang Hyun Lee, Jeju-do (KR); Sang Bum Hur, Daegu (KR); Takaya Kuriyama, Yokohama (KR)

(73) Assignees: Hyundai Motor Company, Seoul (KR); Arvinmeritor Japan K.K., Yokohama (JP); Pyeong Hwa Automotive Co., Ltd., Daegu (KR)

( * ) Notice: Subject to any disclaimer, the term of this patent is extended or adjusted under 35 U.S.C. 154(b) by 451 days.

(21) Appl. No.: 12/336,374

(22) Filed: Dec. 16, 2008

(65) Prior Publication Data

US 2009/0322105 A1 Dec. 31, 2009

(30) Foreign Application Priority Data

Jun. 30, 2008 (KR) ..... 10-2008-0062587

(51) Int. Cl.
*E05C 3/06* (2006.01)
*E05C 3/16* (2006.01)

(52) U.S. Cl. ..... 292/216; 292/DIG. 22; 292/DIG. 65

(58) Field of Classification Search ..... 292/216, 292/336.3, DIG. 3, DIG. 67, DIG. 23, DIG. 22, 292/DIG. 65
See application file for complete search history.

(56) References Cited

U.S. PATENT DOCUMENTS 3,799,596 A * 3/1974 Nozomu et al. ..... 292/216
4,536,021 A * 8/1985 Mochida ..... 292/201
4,703,961 A * 11/1987 Weinerman et al. ..... 292/216
5,865,481 A * 2/1999 Buschmann ..... 292/216
6,010,165 A * 1/2000 Santarelli et al. ..... 292/216
6,053,543 A * 4/2000 Arabia et al. ..... 292/201
6,517,128 B2 * 2/2003 Perkins et al. ..... 292/216
6,883,839 B2 * 4/2005 Belmond et al. ..... 292/201
6,971,688 B2 * 12/2005 Drysdale et al. ..... 292/216
6,997,488 B2 * 2/2006 Kurten et al. ..... 292/201
7,111,880 B2 * 9/2006 Saitoh ..... 292/336.3
7,198,307 B2 * 4/2007 Drysdale et al. ..... 292/216
7,232,164 B2 * 6/2007 Lee ..... 292/336.3
7,607,702 B2 * 10/2009 Pereverzev ..... 292/216
7,699,366 B2 * 4/2010 Hanaki et al. ..... 292/336.3
7,766,397 B2 * 8/2010 Carabalona ..... 292/201
7,827,836 B2 * 11/2010 Cetnar ..... 70/257
8,056,944 B2 * 11/2011 Jankowski et al. ..... 292/216
2009/0102206 A1 * 4/2009 Lee ..... 292/336.3

FOREIGN PATENT DOCUMENTS

JP 2005-120764 A 5/2005

* cited by examiner

*Primary Examiner* — Carlos Lugo
(74) *Attorney, Agent, or Firm* — Morgan, Lewis & Bockius LLP

(57) ABSTRACT

A door latch apparatus for vehicles includes a latch bracket, an outside handle lever pivotally coupled to the latch bracket, wherein one end of the outside handle lever is coupled to an outside handle, a pawl lift pivotally hinged to the other end of the outside handle lever and including a locking portion, a pawl including a pawl pin, wherein the pawl pin is pivotally movable on the latch bracket, the pawl pin and the pawl lift being coupled in a normal state, a latch fork connected to the pawl to lock or unlock a door depending on rotation of the pawl, and a balance weight mounted to the other end of the pawl lift to apply an inertia load to the pawl lift such that the locking portion of the pawl lift is released from the pawl pin when a vehicle collision occurs.

6 Claims, 7 Drawing Sheets

DOOR LATCH APPARATUS FOR VEHICLES

CROSS-REFERENCE TO RELATED APPLICATIONS

The present application claims priority to Korean Patent Application Number 10-2008-0062587, filed on Jun. 30, 2008, the entire contents of which application is incorporated herein for all purposes by this reference.

BACKGROUND OF THE INVENTION

1. Field of the Invention

The present invention relates to a door latch apparatus for vehicles which is constructed such that a door is prevented from opening when a vehicle is involved in a collision.

2. Description of Related Art

Generally, outside door handles are provided on outer surfaces of door panels and are used to open or close the doors. As shown in FIG. 1, a handle base plate 21 is installed in a door panel 10, and a lever 30, which is operated in conjunction with the rotation of an outside door handle 20, is coupled to the handle base plate 21 by a pin shaft 31.

The lower end of the lever 30 is connected to a door latch by a rod or cable 40. A balance weight 50 is integrally provided on the upper end of the lever 30. Furthermore, a return spring is fitted over the pin shaft 31. A first end of the return spring is fastened to the inner surface of the outside door handle 20, and a second end of the return spring is fastened to the inner surface of the balance weight 50.

The construction is such that when the outside door handle 20 is pulled, the lower end of the lever 30 is rotated in the direction corresponding to the direction in which the outside door handle 20 is pulled. Thus, the rod or cable 40, which is connected to the lower end of the lever 30, is pushed. Thereby, the door latch is unlocked, so that the door is opened.

Here, the balance weight applies an inertia load to the lever 30 in the direction opposite the direction in which the outside door handle is operated, in other words, in the direction in which the operation of the outside door handle is restricted and the latched door is prevented from being unlatched.

However, in the conventional technique in which the balance weight is provided on the outside door handle, when the outer panel of the door is deformed by an impact force F generated by a vehicle collision, the balance weight may be pushed inwards. At this time, the lower end of the lever, which is pushed inwards along with the balance weight, is rotated in the same direction as the direction in which the outside door handle is pulled during manual unlatching. Thereby, the door latch may be undesirably unlatched.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a door latch apparatus for vehicles which is constructed such that even if an outside door handle is operated by inertia force or deformation of a door panel when a vehicle is involved in a side collision, the door is prevented from opening.

In an aspect of the present invention, a door latch apparatus for vehicles may include a latch bracket, an outside handle lever pivotally coupled to the latch bracket, wherein one end of the outside handle lever is coupled to an outside handle, a pawl lift, one end of which is pivotally hinged to the other end of the outside handle lever and the other end of which includes a locking portion, a pawl including a pawl pin, wherein the pawl pin is pivotally movable on the latch bracket, and the pawl pin and the other end of the pawl lift are coupled in a normal state, a latch fork connected to the pawl to lock or unlock a door depending on rotation of the pawl, and/or a balance weight mounted to the other end of the pawl lift to apply an inertia load to the other end of the pawl lift toward outside the door such that the locking portion of the pawl lift is released from the pawl pin when a vehicle collision occurs.

The locking portion of the pawl lift may be configured to be recessed from a surface of the other end of the pawl lift so as to receive the pawl pin therein.

The pawl pin may be elastically supported by an elastic member toward the locking portion of the paw lift.

The door latch apparatus may further include a locking lever pivotally coupled to the latch bracket, wherein the locking lever is rotated by an external signal to activate the other end of the pawl lift so as to couple or decouple the pawl pin and the other end of the pawl lift when the external signal is transmitted to the locking lever.

The locking lever may include a contact protrusion to push the other end of the pawl lift when the locking lever is rotated by the external signal, such that the locking portion of the pawl lift is released from the pawl pin.

The other end of the pawl lift may include a locking protrusion configured to correspond to the contact protrusion of the locking lever.

The one end of the pawl lift may be elastically coupled to the other end of the outside handle lever by an elastic member so as to bias the pawl lift toward the pawl pin.

The outside handle lever may be elastically supported by an elastic member coupled to the latch bracket so as to return its original position after an external force applied to the one end of the outside handle lever is removed.

A position adjustment slot may be formed in the other end of the outside handle lever so as to adjust a position coupling the one end of the pawl lift and the other end of the outdoor handle lever.

A hinge shaft formed at the one end of the pawl lift may be coupled to the position adjustment slot so as to be adjustable in position therein.

In another aspect of the present invention, a door latch apparatus for vehicles may include a latch bracket, an outside handle lever pivotally coupled to the latch bracket, wherein one end of the outside handle lever is coupled to an outside handle, a pawl lift, one end of which is pivotally hinged to the other end of the outside handle lever and the other end of which includes a locking portion, a pawl including a pawl pin, wherein the pawl pin is pivotally movable on the latch bracket, and the pawl pin and the other end of the pawl lift being coupled in a normal state, a latch fork connected to the pawl to lock or unlock a door depending on rotation of the pawl, a balance weight mounted to the other end of the pawl lift to apply an inertia load to the other end of the pawl lift toward outside the door such that the locking portion of the pawl lift is released from the pawl pin when a vehicle collision occurs, and/or a locking lever pivotally coupled to the latch bracket, wherein the locking lever is rotated by an external signal to activate the other end of the pawl lift so as to couple or decouple the pawl pin and the other end of the pawl lift when the external signal is transmitted to the locking lever.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
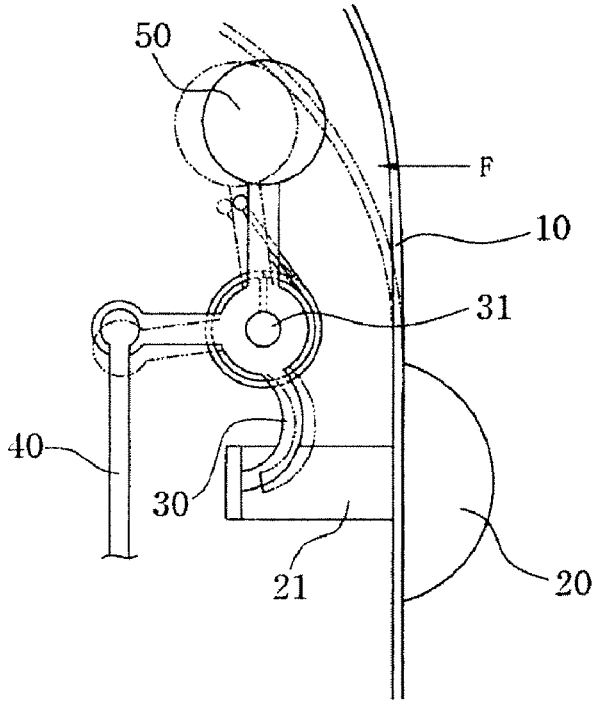
FIG. 1(Prior Art)
FIG. 1 is a view showing the construction of an outside handle of a door for vehicles, according to a conventional technique.
Figure 2:
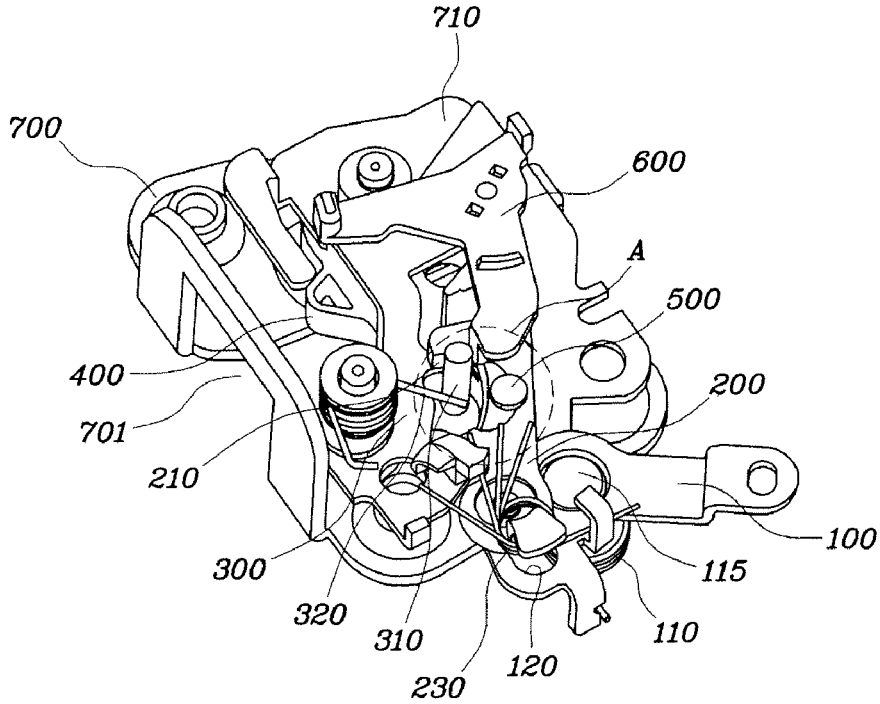
FIG. 2 is a perspective view of an exemplary door latch apparatus for vehicles according to the present invention.
Figure 3:
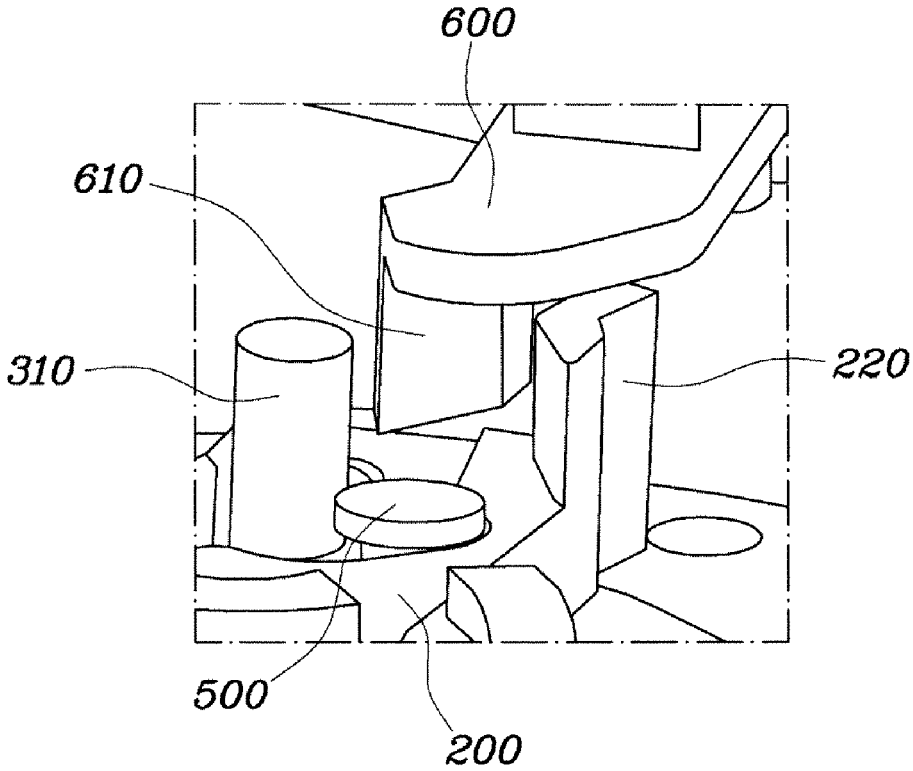
FIG. 3 is an enlarged perspective view of a circled portion "A" of FIG. 2.
Figure 4:
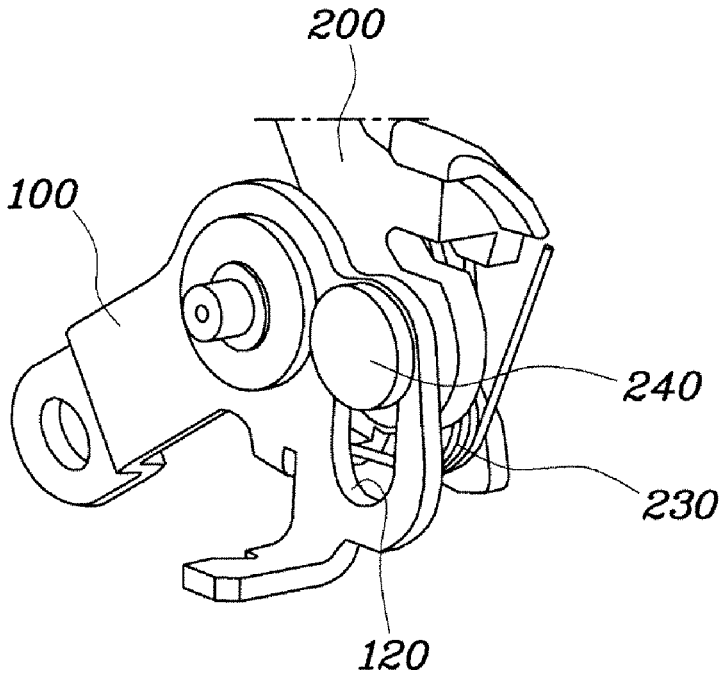
FIG. 4 is a perspective view of an enlargement of an exemplary outside handle lever of the door latch apparatus according to the present invention.

FIG. 2 is a perspective view of a door latch apparatus for vehicles, according to various embodiments of the present invention. FIG. 3 is an enlarged perspective view of a circled portion "A" of FIG. 2. FIG. 4 is a perspective view of an enlargement of an outside handle lever of the door latch apparatus according to various embodiments of the present invention.

As shown in FIGS. 2 through 4, the door latch apparatus for vehicles according to various embodiments is characterized in that it includes a balance weight for providing an inertia load so that when the vehicle is involved in a collision, the door is prevented from undesirably opening, and after the collision, the door latch can be normally operated.

To achieve the above purpose, the door latch apparatus, as does various embodiments of the present invention, includes an outside handle lever 100 that is rotatably mounted to a latch bracket 700, a pawl lift 200, which is hinged to the outside handle lever 100 and is selectively locked to a pawl pin 310 of a pawl 300, and a balance weight 500, which is mounted to the pawl lift 200.

The outside handle lever 100 is connected at a first end thereof to an outside handle through an actuation cable. A second end of the outside handle lever 100 is rotatably coupled to the pawl lift 200 using a hinge shaft 240. An elastic spring 110 is provided between the outside handle lever 100 and the latch bracket 700 to elastically support the outside handle lever 100.

When the outside handle is pulled, the actuating force thereof is transmitted to the outside handle lever 100 through the actuation cable. Then, the outside handle lever 100 rotates around the hinge shaft 115 and thus pulls the pawl lift 200. When the outside handle is released, the outside handle lever 100 is rotated to its original position by the elastic restoring force of the elastic spring 110 and the pawl lift 200 is thus returned to its original position.

Preferably, a position adjustment slot 120, into which the hinge shaft 240 of the pawl lift 200 is inserted, may be formed in the outside handle lever 100. The position adjustment slot 120 enables the hinge shaft 240 of the pawl lift 200 to be adjusted in position during an assembly process, thus reducing an assembly tolerance.

The pawl lift 200 is hinged to the outside handle lever 100 and has a recessed locking portion 210, which is selectively locked to the pawl pin 310 of the pawl 300.

In various embodiments, an elastic spring 230 is provided between the pawl lift 200 and the outside handle lever 100 to elastically support a first end of the pawl lift 200. In an unlocked state of the door, when the pawl lift 200 is rotated by the outside handle lever 100, the recessed locking portion 210 of the pawl lift 200 is locked to the pawl pin 310 of the pawl 300. The pawl pin 310, which is in the locked state, is rotated by the pawl lift 200, thus enabling a latch operation of a latch fork 400.

A locking protrusion 220 is provided on a second end of the pawl lift 200 such that the pawl lift 200 is operated in conjunction with a locking lever 600. The locking lever 600 has a contact protrusion 610, which rotates the second end of the pawl lift 200 when a locking signal of the door is transmitted. The locking lever 600 is rotatably mounted to a support bracket 710 of the latch bracket 700.

Therefore, when the locking lever 600 is rotated in the locked state of the door, the contact protrusion 610 of the locking lever 600 pushes the locking protrusion 220 of the pawl lift 200, thus rotating the pawl lift 200. Thereby, the recessed locking portion 210 of the pawl lift 200 which has held the pawl pin 310 is removed from the pawl pin 310. As a result even though the pawl lift 200 is rotated by the outside handle lever 100, the door is prevented from being opened because the pawl pin 310 does not rotate to operate the latch fork 400.

In various embodiments of the present invention, the pawl lift 200 is provided with the balance weight 500. The balance weight 500 functions to apply an inertia load to the second end of the pawl lift 200 when the vehicle is involved in a collision, and release the recessed locking portion 210 of the pawl lift 200 from the pawl pin 310, thus preventing the door from being opened. In other words, when a load is applied to the door by a vehicle collision, the balance weight 500 rotates the pawl lift 200 in the direction, in which the recessed locking portion 210 of the pawl lift 200 is removed from the pawl pin 310 by the inertial load. Therefore, even if the outside handle lever 100 is rotated by undesirable rotation of the outside handle as a result of vehicle collision, because the recessed locking portion 210 of the pawl lift 200 cannot rotate the pawl pin 310 of the pawl 300, the door is prevented from opening.

After the vehicle collision has occurred, the pawl lift 200, which has been rotated in the direction in which the recessed locking portion 210 becomes removed from the pawl pin 310, is returned to its original position by the elastic restoring force of the elastic spring 230. Thus, the recessed locking portion 210 of the pawl lift 200 is locked to the pawl pin 310 again. Hence, even after the vehicle collision has occurred, the door latch can be normally operated.

The operation and effect of various embodiments of the present invention, having the above-mentioned construction will be explained herein below.

Figure 5A:
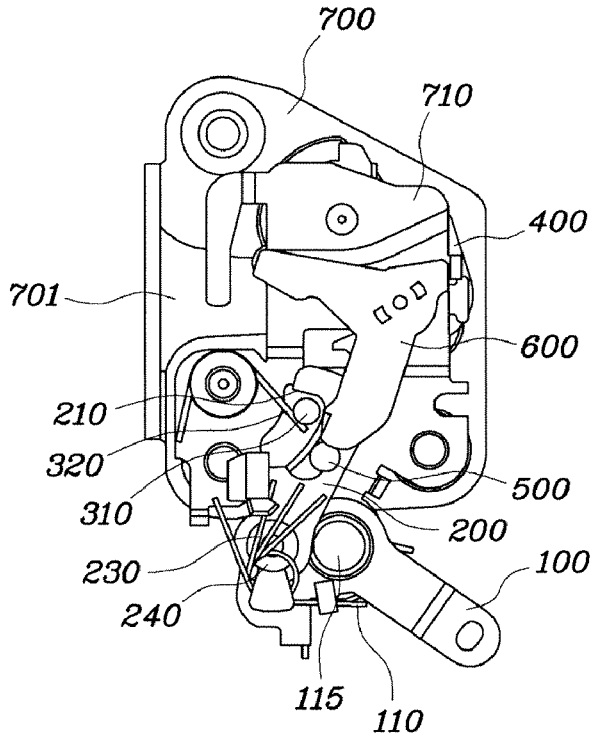
FIGS. 5A and 5B are views illustrating the operation of the door latch apparatus when it is in an unlocked state according to the present invention.
Figure 5B:
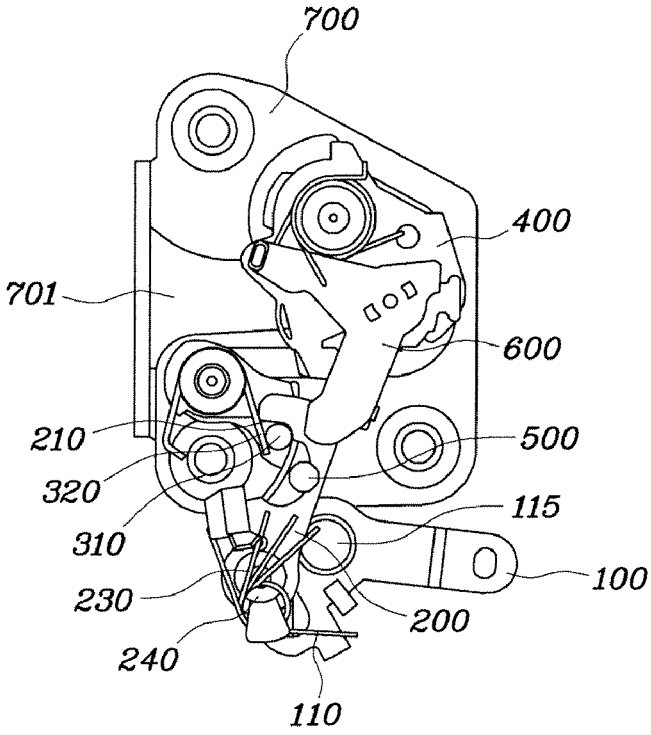

FIGS. 5A and 5B are views illustrating the operation of the door latch apparatus when it is in an unlocked state according to various embodiments of the present invention.

As shown in FIGS. 5A and 5B, when the outside handle is pulled in the unlocked state of the door, the actuation force is transmitted to the outside handle lever 100 through the actuation cable and the outside handle lever 100 is thus rotated in a counterclockwise direction. Then, the pawl lift 200 is rotated in a counterclockwise direction by the rotation of the outside handle lever 100, so that the recessed locking portion 210 of the pawl lift 200 is locked to the pawl pin 310 of the pawl 300.

Thereafter, the pawl lift 200 rotates the pawl 300, which is locked to the recessed locking portion 210. The latch fork 400 is also rotated by the rotation of the pawl 300. As a result, the door is opened by the operation of the latch fork 400.

The pawl pin 310 is elastically supported by an elastic spring 320 so that the pawl pin 310 return its original position by the elastic spring 320 as the outdoor handle lever 100 rotates in the clockwise direction.

Figure 6A:
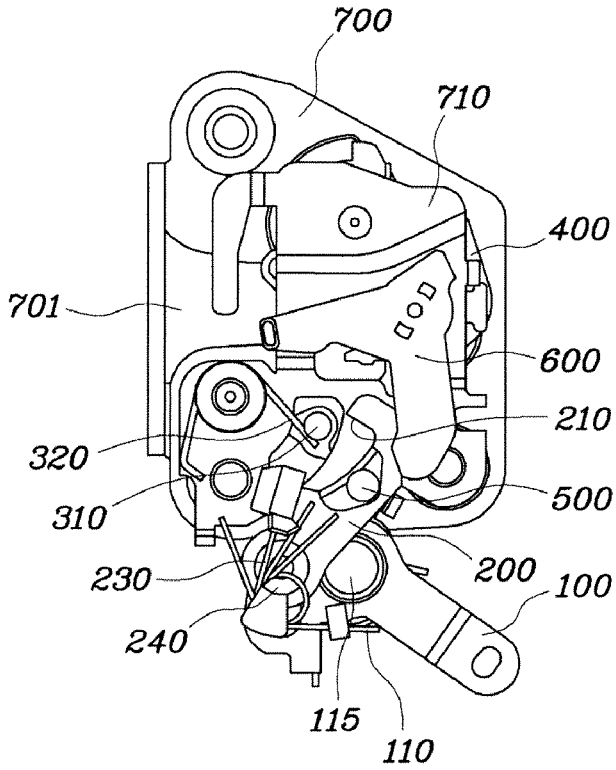
FIGS. 6A and 6B are views are views illustrating the operation of the door latch apparats when it is in a locked state according to the present invention.
Figure 6B:
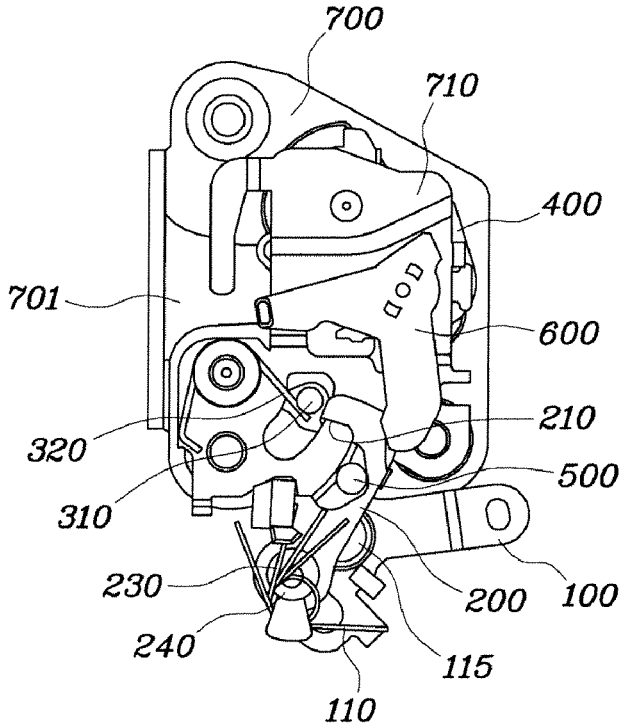

FIGS. 6A and 6B are views are views illustrating the operation of the door latch apparatus when it is in a locked state according to various embodiments of the present invention.

As shown in FIG. 6A, when the locking lever 600 is rotated in a counterclockwise direction in the locked state of the door, the contact protrusion 610 of the locking lever 600 pushes the locking protrusion 220 and thus rotates the pawl lift 200 in the clockwise direction. Thus, the recessed locking portion 210 of the pawl lift 200 which has been held by the pawl pin 310 is removed from the pawl pin 310. The pawl pin 310 is elastically supported by an elastic spring 320 and maintains its original position by the elastic spring 320 so that the door is locked.

In other words, as shown in FIG. 6B, even though the pawl lift 200 is rotated in a counterclockwise direction by the outside handle lever 100, the latch operation of the door using the pawl pin 310 cannot be conducted. Therefore, the locked state of the door is maintained.

Figure 7A:
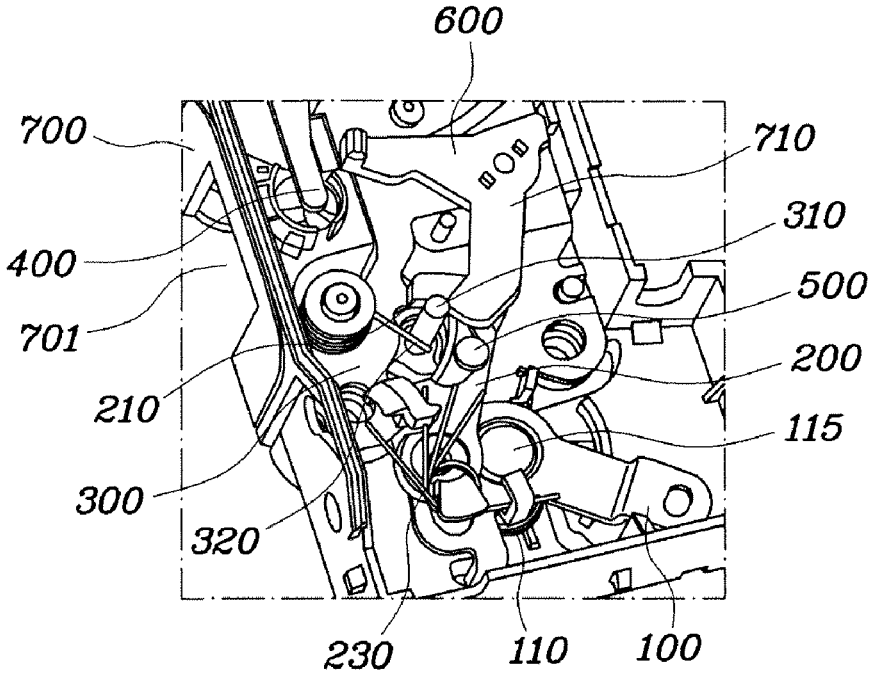
FIGS. 7A through 7C are views illustrating the operation of the door latch apparatus when the vehicle is involved in a side collision according to the present invention.
Figure 7B:
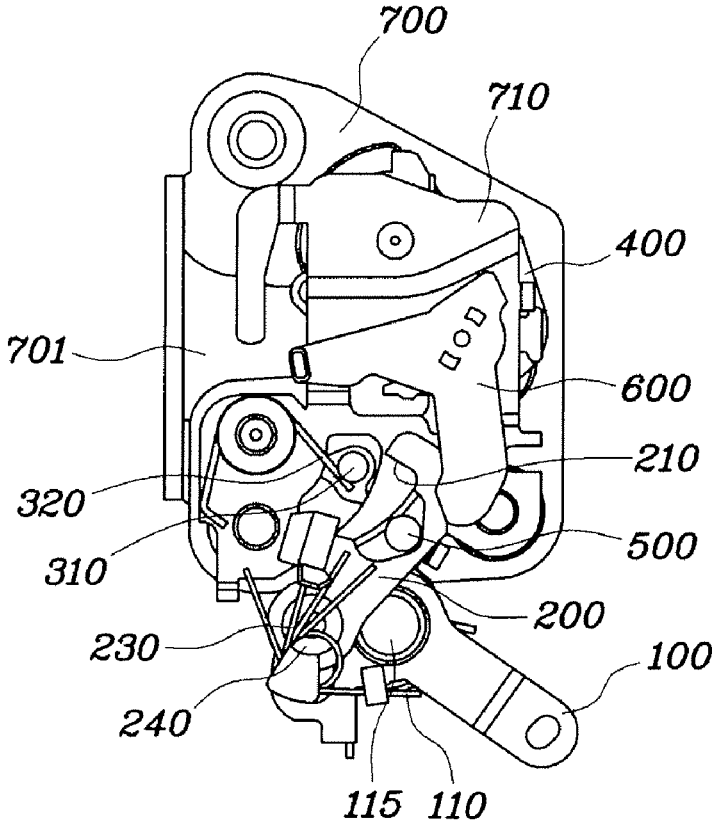
Figure 7C:
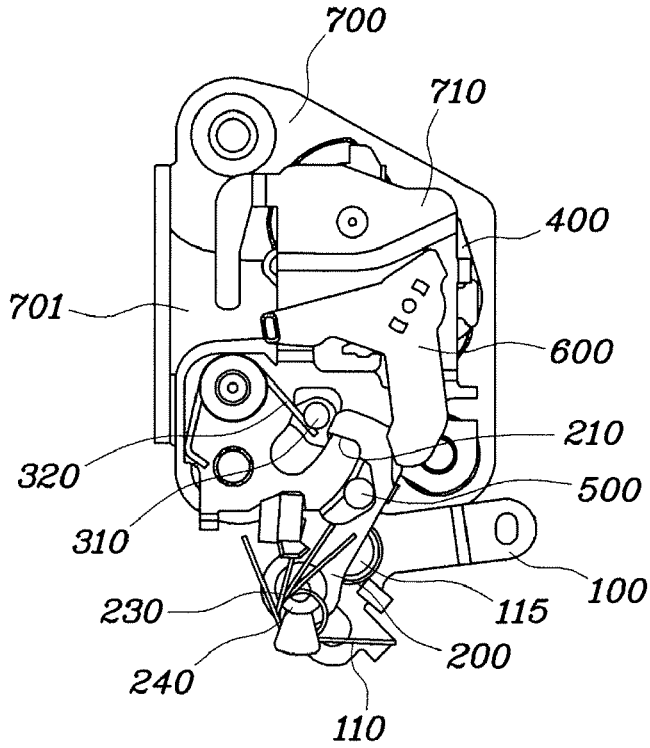

FIGS. 7A through 7C are views illustrating the operation of the door latch apparatus when the vehicle is involved in a side collision according to various embodiments of the present invention.

As shown in FIGS. 7A through 7C, when the vehicle is involved in a side collision, the balance weight 500 applies an inertia load to the second end of the pawl lift 200, thus rotating the pawl lift 200 in a clockwise direction. Thereby, the recessed locking portion 210 of the pawl lift 200 is removed from the pawl pin 310.

Therefore, as shown in FIG. 7C, even if the outside handle is rotated by the vehicle collision and the outside handle lever 100 is thus rotated, the door is prevented from being opened.

Figure 8A:
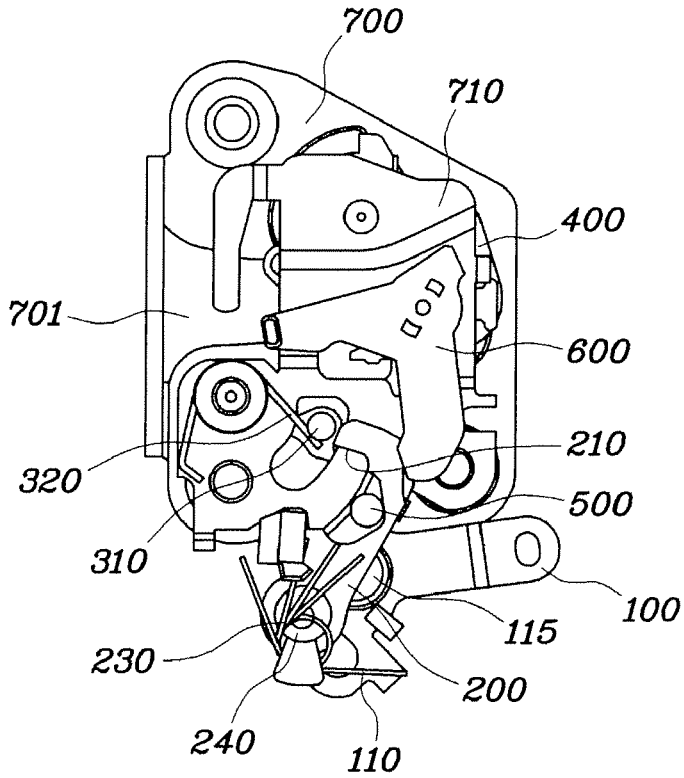
FIGS. 8A and 8B are views illustrating the operation of the door latch apparatus when it is in the unlocked state after the vehicle has been involved in the side collision according to the present invention.
Figure 8B:
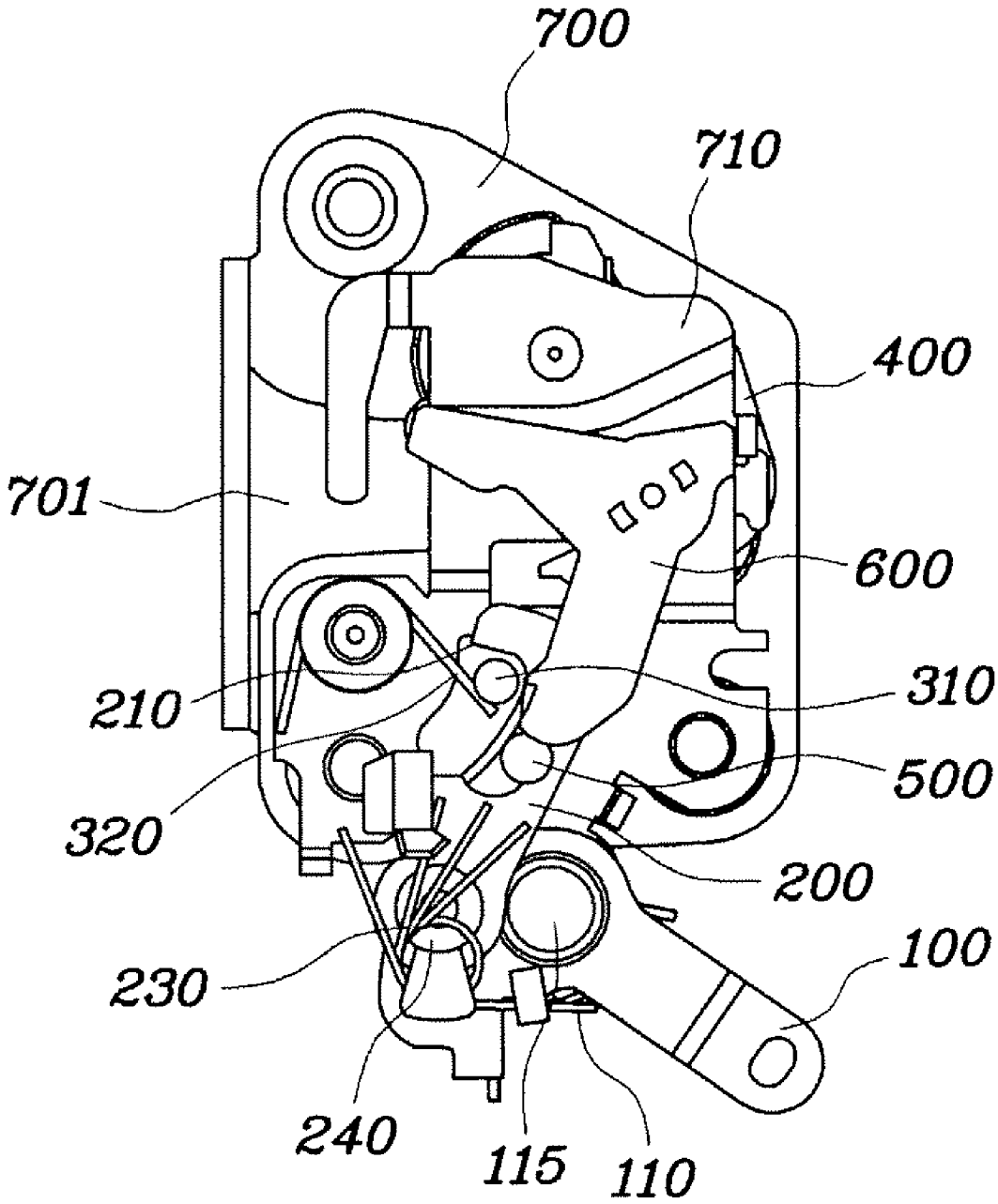

FIGS. 8A and 8B are views illustrating the operation of the door latch apparatus when it is in the unlocked state after the vehicle has been involved in the side collision according to various embodiments of the present invention.

As shown in FIGS. 8A and 8B, after the vehicle collision has occurred, the pawl lift 200, which has been rotated by the balance weight 500 in a counterclockwise direction, is returned to its original position by the elastic restoring force of the elastic spring 230. Thus, the recessed locking portion 210 of the pawl lift 200 is locked to the pawl pin 310 again.

In this state, when the outside handle is pulled, the pawl lift 200 pulls and rotates the pawl 300, which is locked to the recessed locking portion 210. Then, the latch fork 400 is also rotated by the rotation of the pawl 300. Therefore, the door can be opened by the operation of the latch fork 400. As such, even after the vehicle collision has occurred can the door latch be normally operated.

As described above, in a door latch apparatus according to various aspects of the present invention, even if an outside handle of a door is undesirably operated by inertia force or deformation of the door when a side collision occurs, the door can be prevented from being opened. Furthermore, even after the vehicle collision is over can the door latch be normally operated.

In particular, a balance weight, which provides an inertia load when a vehicle collision occurs, is provided in the door latch apparatus. Therefore, the balance weight is prevented from being undesirably moved by deformation of the outer panel of the door when the collision occurs. Thus, the present invention can reliably prevent the door latch from being undesirably released when the vehicle is involved in a collision.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention as well as various alternatives and modifications thereof. It is intended that the scope of the invention be defined by the Claims appended hereto and their equivalents.

What is claimed is:

1. A door latch apparatus for vehicles, comprising;

a latch bracket;

an outside handle lever pivotally coupled to the latch bracket and having a first end being directly pulled by operation of an outside handle;

a pawl lift having one end pivotally hinged to the a second end of the outside handle lever and an opposed end that includes a locking portion;

a first elastic member being provided between the outside handle lever and the pawl lift to elastically return the pawl lift to an original position;

a latch fork pivotally coupled to the latch bracket and moved between a latched position and an unlatched position;

a pawl pivotally coupled to the latch bracket and operatively connected to the pawl lift, the pawl is configured to be moved between an engaged position, maintaining the latch fork in the latched position, and a release position, allowing the latch fork to move toward the unlatched position, the pawl including a pawl pin in contact with the locking portion of the pawl lift;

a balance weight fixed to the opposed end of the pawl lift and configured to apply an inertia load to the opposed end of the pawl lift toward outside the door such that the locking portion of the pawl lift is released from the pawl pin by overcoming a restoring force of the first elastic member when a vehicle collision occurs;

a second elastic spring is supporting the pawl pin to return the pawl pin toward engagement with the locking portion of the pawl lift after the vehicle collision occurs, allowing the door latch apparatus to be normally operated after the collision;

a locking lever pivotally coupled to the latch bracket, wherein the locking lever is rotated by an external force to activate the opposed end of the pawl lift so as to couple or decouple the pawl pin and the locking portion when an external signal is transmitted to the locking lever;

wherein the locking lever includes a contact protrusion to push the opposed end of the pawl lift when the locking lever is rotated by the external force, such that the locking portion of the pawl lift is released from the pawl pin; and wherein, when the opposed end of the pawl lift includes a locking protrusion configured to correspond to the contact protrusion of the locking lever.

2. The door latch apparatus as set forth in claim 1, wherein the locking portion of the pawl lift is configured to be recessed from a surface of the other end of the pawl lift so as to receive the pawl pin therein.

3. The door latch apparatus as set forth in claim 1, wherein the outside handle lever is elastically supported by a third elastic member coupled to the latch bracket wherein the third elastic member returns the outside handle lever to original position after an external force applied to the one end of the outside handle lever is removed.

4. The door latch apparatus as set forth in claim 1, wherein a position adjustment slot is formed in the other end of the outside handle lever so as to adjust a position coupling the one end of the pawl lift and the other end of the outdoor handle lever.

5. The door latch apparatus as set forth in claim 4, wherein a hinge shaft formed at the one end of the pawl lift is coupled to the position adjustment slot so as to be adjustable in position therein.

6. A passenger vehicle comprising the door latch apparatus as set forth in claim 1.

* * * * *